United States Patent [19]

Shenoy et al.

[11] 4,160,774

[45] Jul. 10, 1979

[54] PROCESS OF DEGUMMING FATTY GLYCERIDES USING SODIUM ACETATE AND ACETIC ACID BUFFER

[75] Inventors: Raghuram D. Shenoy; Ananthram Ganapathy, both of Bombay, India

[73] Assignee: Cadbury India Limited, Bombay, India

[21] Appl. No.: 872,183

[22] Filed: Jan. 25, 1978

[51] Int. Cl.[2] ..... C11B 3/04
[52] U.S. Cl. ..... 260/424
[58] Field of Search ..... 260/424

[56] References Cited

U.S. PATENT DOCUMENTS

| | | | |
|---|---|---|---|
| 2,351,184 | 6/1944 | Boone | 260/424 |
| 3,590,059 | 6/1971 | Velan | 260/424 |
| 4,089,880 | 5/1978 | Sullivan | 260/424 |

FOREIGN PATENT DOCUMENTS

| | | | |
|---|---|---|---|
| 443058 | 9/1974 | U.S.S.R. | 260/424 |

*Primary Examiner*—P. E. Konopka
*Attorney, Agent, or Firm*—Lester Horwitz

[57] ABSTRACT

A new process for degumming fatty glycerides is disclosed where a sodium acetate and acetic acid buffer having a pH of 3 to 5 is added to crude vegetable fat containing the fatty glycerides. The degummed fatty glycerides are then removed from the buffer.

4 Claims, No Drawings

PROCESS OF DEGUMMING FATTY GLYCERIDES USING SODIUM ACETATE AND ACETIC ACID BUFFER

This invention relates to the pre-treatment of fatty glycerides and in particular to the degumming of certain non-traditional fatty glycerides like crude sal seed fat.

A number of methods exist for removing gums, resins, proteins and phosphatides from crude oils and fats. If the crude oil is not properly degummed, subsequent steps involved in the process of refining such as neutralization, bleaching, deodorization will not proceed smoothly and the final products will not be of high quality. Crude oils can be deslimed by treatment with steam, water or electrolytes, followed by settling, centrifugation or filtration with absorbents or other aids.

Most solvent extracted oils contain considerable amounts of phosphatides and other mucilaginous materials which during storage form deposits in the storage tanks. A high gum content of the crude oil also increases refining losses considerably, as the gums will emulsify a considerable amount of neutral oil which is lost in the soap stock. Therefore, a separate degumming operation is necessary for solvent extracted oils. Thus, solvent extracted soya bean and cottonseed oils are degummed with special reagents, such as acetic anhydride and phosphoric acid prior to alkali treatment.

Crude sal fat obtained by solvent extraction contains varying amounts of non-glyceride impurities, such as free fatty acids, non-fatty materials generally classified as "gums" or phosphatides, color pigments (chlorophyll) and certain undesirable phenolic compounds called ellagitannins in trace amounts. The unsaponifiable matter content in solvent extracted crude sal fat varies from 1% to 4% and even more than this sometimes. The alcoholic extract of sal seeds gives a positive test for the presence of phenols which has been identified as ellagic acid by ultra violet and infra red spectral data. Ellagic acid occurs widely in the plant kingdom. Ellagitannins are complex ester glycosides and occur largely in myrobalans and oak galls.

Crude sal fat when processed by conventional refining technique without subjecting it to a degumming operation is difficult to alkali refine, bleach and deodorize, leaving a residual "tanny" flavor in the processed fat. So, if processed sal fat, which exhibits properties very similar to cocoa butter is to be used in confections, it should be free from any undesirable "tanny" flavor after deodorization.

It is therefore an object of the present invention to provide a method of degumming crude sal fat with a special reagent to remove the undesirable phenolic compounds and other non-glyceride impurities prior to alkali refining.

Accordingly, the present invention provides a process of degumming fatty glycerides which comprises adding sodium acetate and acetic acid buffer at a pH of 3 to 5 to molten crude vegetable fat. Thus, when sal fat is subjected to the process of the present invention, the undesirable tannins and phenols with special reference to ellagic acid along with gums and mucilaginous matter are removed, in which the degumming is carried out in the presence of a reagent containing sodium acetate and acetic acid buffer (4.5 pH). This reagent, when added to crude sal fat as a 10% solution in quantities varying between 0.1 to 0.5% complexes ellagic acid and other phenols having properties similar to those of ellagic acid. The loose complex so formed is removed in the degumming operation along with gums and mucilaginous matter. The removal of ellagic acid and similar phenols from raw sal fat by this procedure was confirmed by using the spectroscopic properties of ellagic acid.

Preferably the crude sal fat is degummed by using a reagent, such as phosphoric acid and/or citric acid in addition to sodium acetate-acetic acid buffer. The amount of phosphoric acid and/or citric acid used may lie in the range of 0.01% to 1% based on the weight of oil.

The advantage of degumming raw sal fat by using the reagents according to the present invention can be summarized as follows:

(a) Refining losses are reduced markedly.
(b) Degummed and alkali refined fat is easy to bleach.
(c) The deodorized fat is free from undesirable "tanny" taste or any other odour reversion.
(d) The processed fat possesses good stability towards oxidative rancidity.

The invention can be illustrated by means of the following examples:

EXAMPLE 1

0.5% of sodium acetate-acetic acid reagent a a 10% solution was used as the degumming agent. It was added to the crude melted sal fat, at about 40° C., with agitation. The temperature of the mixture was then raised to about 60° C., with agitation and the mixture allowed to settle. The degummed oil was siphoned out by means of a skim pipe. The degummed oil was given a 10% by weight hot water wash and after settling the aqueous phase removed.

Table 1

| Ultra Violet Spectrascopic Analysis of Pre-treated Sal Fat | | |
|---|---|---|
| Absorbance at | Crude Fat | Pre-treated Fat |
| 255 mμ | 0.615 | 01.415 |
| 366 m μ | 0.122 | 0.0278 |

EXAMPLE 2

This example illustrates the invention as applied to crude sal fat in the presence of citric and phosphoric acids.

Crude sal fat containing 3% free fatty acids was degummed using sodium acetate-acetic acid reagent as described in Example 1. This was then treated with 0.01% each of phosphoric acid and citric acid based on the weight of oil as a 10% solution. The purpose of adding phosphoric acid or citric acid to the melted crude sal fat was to chelate any metallic impurities present in it and also to complete the degumming operation.

Table 2

| Ultra Violet Spectrascopic Analysis of Pre-treated Sal Fat | | |
|---|---|---|
| Absorbance at | Crude Fat | Pre-treated Fat |
| 255 m μ | 0.721 | 0.490 |
| 366 m μ | 0.136 | 0.0745 |

The fat when degummed by any of the above methods was easy to refine, bleach and deodorize.

We claim:

1. A process for degumming fatty glycerides which comprises the steps of:

(a) adding sodium acetate and acetic acid buffer to molten crude vegetable sal fat containing the fatty glycerides wherein said sodium acetate-acetic acid buffer is in the pH range of 3 to 5; and (b) removing the fatty glycerides degummed during step (a) from the sodium acetate-acetic acid buffer solution.

2. A process according to claim 1 wherein phosphoric acid and/or citric acid is/are added to said sodium acetate-acetic acid buffer.

3. A process according to claim 2 wherein the amount of phosphoric acid and/or citric acid is in the range of 0.01% to 1% on the weight of crude vegetable fat.

4. A process according to claim 1 wherein the sodium acetate-acetic acid buffer is added as a 10% solution in an amount between 0.1 and 0.5% to said vegetable fat.

* * * * *